US006651301B1

(12) United States Patent
Liu

(10) Patent No.: US 6,651,301 B1
(45) Date of Patent: Nov. 25, 2003

(54) ADJUSTABLE HAND TOOL WITH DUAL FUNCTIONS

(76) Inventor: Yang-Ting Liu, No. 76-1, Lin 4, Shang-Kuan Li, Yuan Li Town, Miao Li Hsien (TW)

( * ) Notice: Subject to any disclaimer, the term of this patent is extended or adjusted under 35 U.S.C. 154(b) by 0 days.

(21) Appl. No.: 10/183,693

(22) Filed: Jun. 28, 2002

(51) Int. Cl.[7] ..... B21J 15/04; B21J 15/38

(52) U.S. Cl. ..... 29/243.521; 29/243.528; 81/341; 81/385

(58) Field of Search ..... 29/243.521, 243.528; 81/341, 385

(56) References Cited

U.S. PATENT DOCUMENTS 946,074 A * 1/1910 Seessle ..... 81/341
1,219,160 A * 3/1917 Rosenblatt ..... 81/341
2,571,819 A * 10/1951 Boel et al. ..... 81/341
4,344,311 A * 8/1982 Inoue ..... 29/243.528
4,347,729 A * 9/1982 Mitani ..... 29/243.528
4,807,460 A * 2/1989 Tzong ..... 29/243.528
5,050,420 A * 9/1991 Liu ..... 72/391.4

* cited by examiner

*Primary Examiner*—David Jones
(74) *Attorney, Agent, or Firm*—Rosenberg, Klein & Lee

(57) ABSTRACT

A dual function adjustable hand tool including a head device having a hollow and a room. The hollow is coupled to the room and threaded on one side to screw with a pull-over member. The room further includes a leverage system. An adjusting device is placed between the lead device and the lower handle, and has at least one wheel that includes a hole, with a connecting shaft passing through it and a hole with a connecting rod passing through it. One side of the connecting rod couples to the second side of the leverage and the other side of the connecting rod screws to a sleeve which is coupled to the upper handle by a pin. The device further includes, a concavity and a wave spring; a setting device having a connecting nut, a setting rod and a setting nut wherein the connecting nut is screwed with the setting rod; and an assembly device including a connecting sleeve and a connecting device.

6 Claims, 6 Drawing Sheets

ADJUSTABLE HAND TOOL WITH DUAL FUNCTIONS

BACKGROUND OF THE INVENTION

1. Field of the Invention

The present invention relates to a hand tool. More specifically, the present invention discloses an adjustable hand tool with adjustable operating distance and angle, and having riveting and nut insertion functions.

2. Description of Prior Art

Traditionally riveters and nut-riveters have been used in industry and carpentry. However, users must buy or carry both the riveter and nut-riveter which is inconvenient. Furthermore, the traditional tools require the user to squeeze the handles of the tools, which are connected to a central rod, in order to pull the central rod and insert-nut in order to deform the rivet and insert-nut for fastening. However, since the operating distance of the handle is fixed, it is difficult for the user apply force on the handle if the operating distance is too long. If the operating distance is too short, the insert-nut doesn't deform properly so the attachment is loose. These are some of the disadvantages of the conventional hand-tools.

Additionally, hand tools needed operate at various angles such as vertical or horizontal, on a high or low plane. To date, some hand tools have adjustable functions but require additional tools to make the adjustments. When a user is using the tool in a high altitude situation, the user is put into further.

SUMMARY OF THE INVENTION

It is an object of the present invention to provide an adjustable hand tool having riveting functions and inserting nut functions, one tool comprising two systems increases convenience.

It is another object of the present invention to provide an adjustable hand tool comprising an adjustable nut for adjusting the operating distance of the handle in order to adapt to operating needs.

It is yet another object of the present invention to provide an adjustable hand tool which can be adjusted without the need for other tools and parts can be changed in order to increase convenience for the user.

BRIEF DESCRIPTION OF DRAWINGS

The above and further objects, features and advantages of the invention will become clear from the following more detailed description when read with reference to the accompanying drawings in which.

DETAILED DESCRIPTION OF THE PREFERRED EMBODIMENTS

Figure 1:
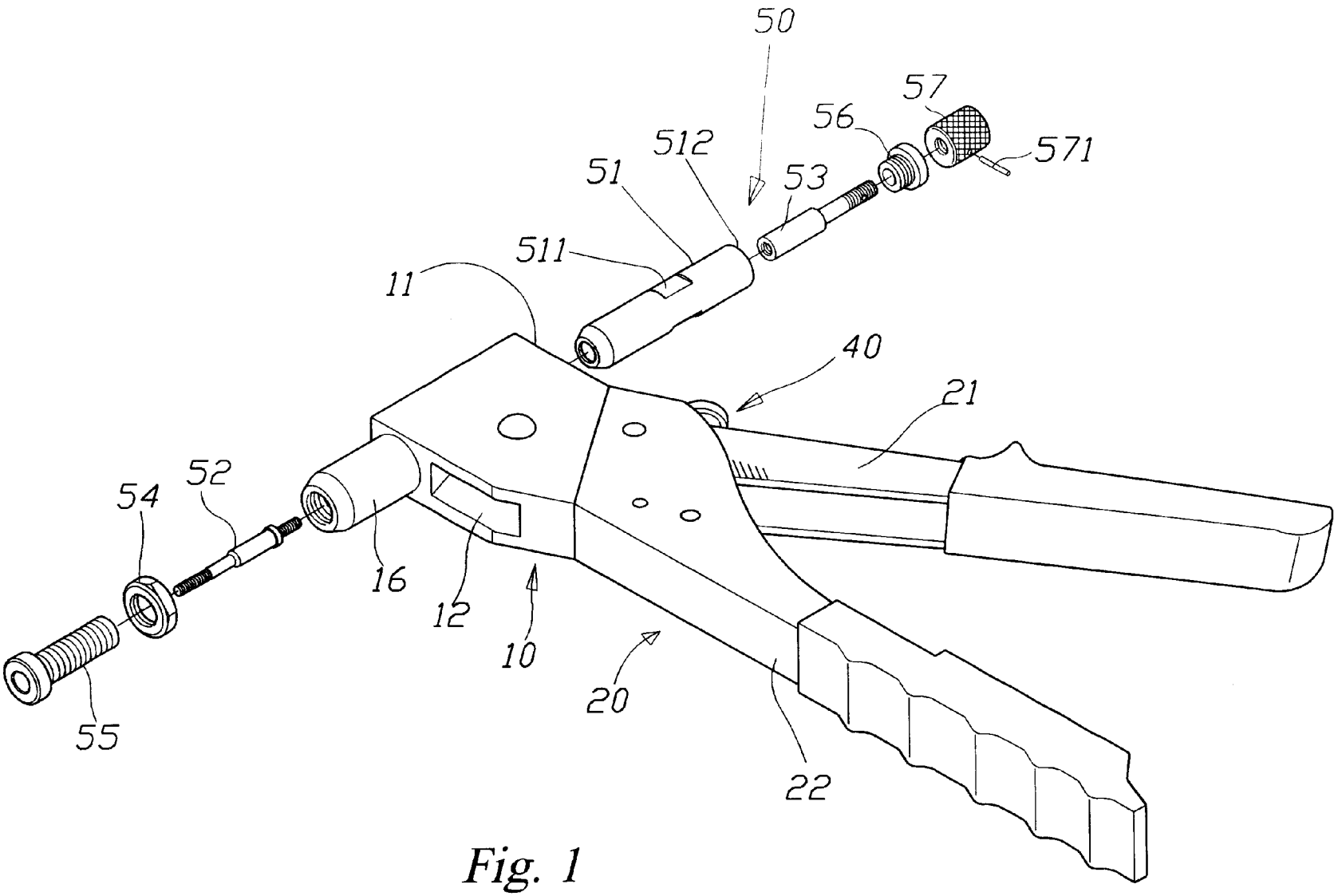
FIG. 1 is an explode view illustrating the multiple function hand tool according to an embodiment of the present invention.
Figure 2:
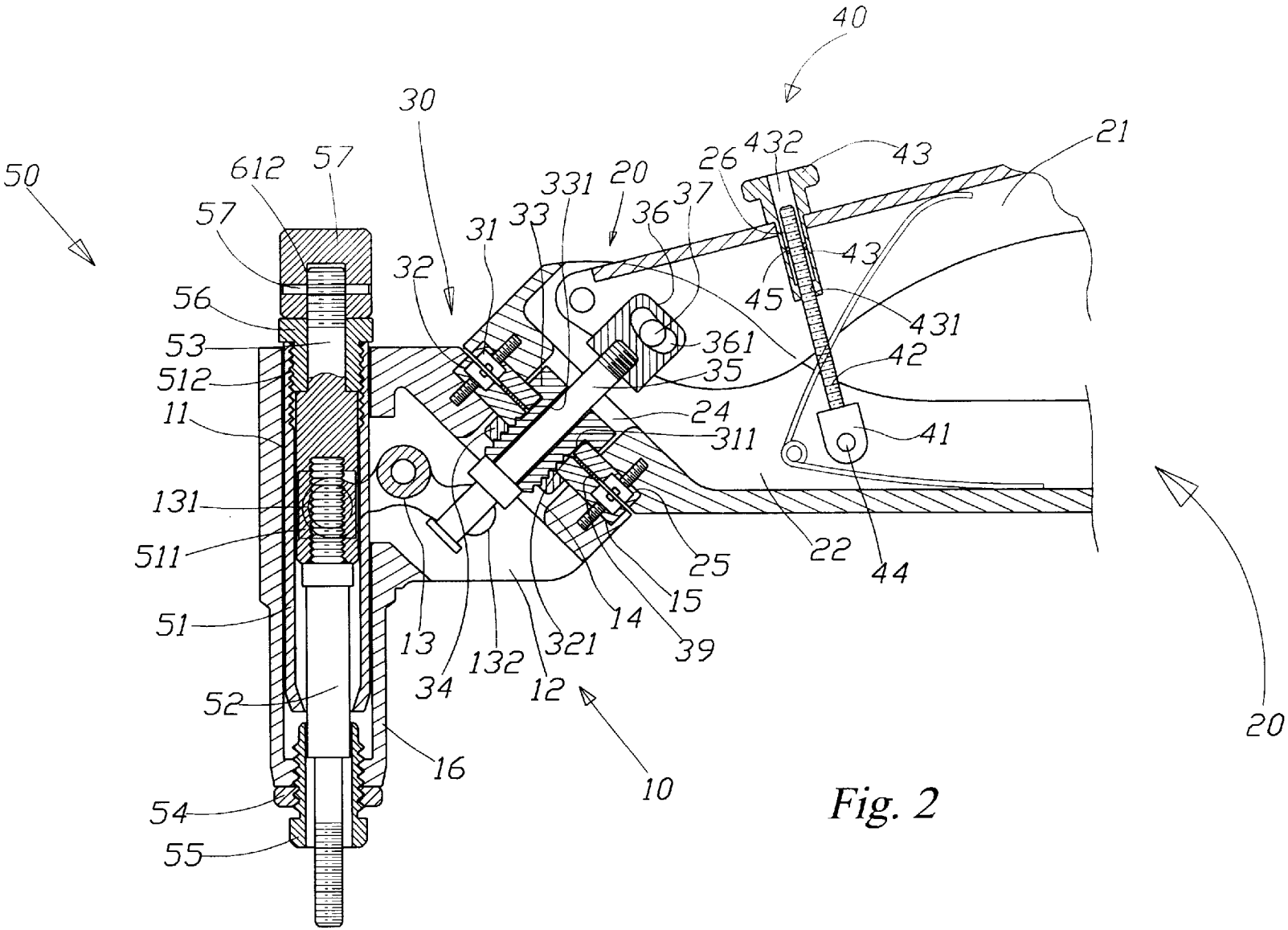
FIG. 2 is a perspective view illustrating the multiple function hand tool according to an embodiment of the present invention.

Referring to FIGS. 1 and 2, the adjustable hand tool comprises a head device 10, a handle 20, an adjustable device 30, a setting device 40 and a connecting device 50. The head device 10 comprises a hollow 11 and a room 12. Between the hollow 11 and the room 12 is a pivotal leverage 13 comprising a first side 131 and a second side 132 wherein the first side 131 extends in hollow 11. The handle 20 comprises an upper handle 21 and a lower handle 22 wherein between them is a spring 23 and a positioning hole 26 on upper handle 21. Furthermore, the head device 10 and lower handle 22 connect at and angle of 45 degrees and includes apertures 14,24 and concavities 15,25.

The adjustable device 30 comprises an upper wheel 31 and a lower wheel 32 fastening respectively to the concavities 25,15 between the lower handle 22 and the head device 10. The upper wheel 31 and the lower wheel 32 having holes 311 and 321 which provide a connecting shaft 33 through them and placed in the apertures 14,24 between the lower handle 22 and the head device 10 and fastened by a nut 34. The connecting shaft 33 comprises a shaft hole 331 providing a connecting rod 35, one side of it connecting to the second side of leverage 13 and the other side of it fastening to a sleeve 36 comprising an arc channel 361 being connected pivotally to upper handle 21 by a pin 37. Furthermore, the inside of upper wheel 31 and lower wheel 32 further includes a spring 39.

Figure 3:
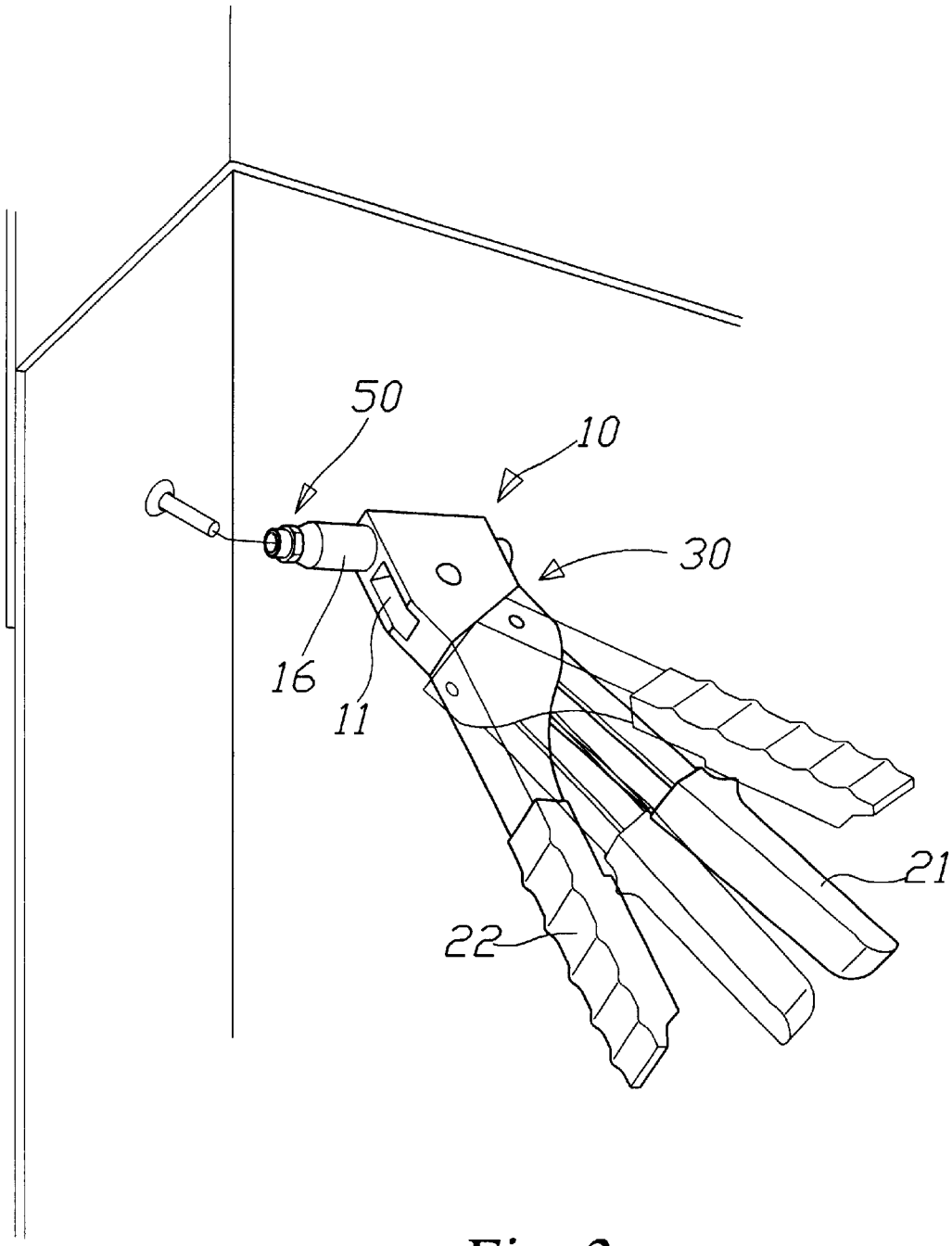
FIG. 3 is a drawing illustrating changing the angle of the multiple function hand tool according to an embodiment of the present invention.

The angle of the adjustable hand tool can be changed by forcing the head device to rotate 180 degrees (clockwise or counter clockwise). Refer to FIG. 3 which illustrates the angle of the hand tool in a changed position.

The setting device 40 comprises a connecting nut 41, a setting rod 42 and a setting nut 43 (refer to FIG. 2). The connecting nut 41 is placed in the lower handle 22 by a pin 44 and fastened to the setting rod 44. The setting nut 43 passes through the positioning hole 26 of upper handle 21 and comprises an inside thread 431 fastened to the setting rod 42 and a setting hole 432 provides a passage for the setting rod 42 through it. The setting rod 42 in the setting hole 432 has a rubber pad 45 to increase the friction between the setting nut 43 and the setting rod 42 to prevent looseness.

When adjusting the setting nut 43, the setting rod 42 moves in an axial direction in setting hole 432 of setting nut 43 to adjust the distance between the upper handle 21 and the lower handle 22. This has the effect on the hand tool in adjusting the operating distance.

The connecting device 50 comprises a connecting sleeve 51, a pull rod 52, a pull sleeve 53, a fastening nut 54, an adjustable screw 55, a fastening screw 56 and a rotating member 57. The connecting sleeve 51 is placed in hollow 11 of head device 10 and pull-over member 16 and comprises a recession 511 and an inside thread 512 wherein the recession 511 is moved by the first side 131 of leverage 13. The one side of pull rod 52 screws to the pull sleeve 53 by passing through the connecting sleeve 51 and the other side of pull rod 52 passes through the pull-over member 16 the fastening nut 54 and adjustable screw 55. The pull sleeve 53 passes through the fastening screw 56 to the rotating member 57 and is fastened by a pin 571.

When an insertion nut is placed in the bottom of the pull rod 52, the user squeezes the upper handle 21 to move the pull rod 52 forward or backward by connecting rod 35, leverage 13, fastening screw 56 and connecting sleeve 51 to complete the fastening of the inserting nut and rotates the rotating member 57 to release the inserting nut.

Figure 4:
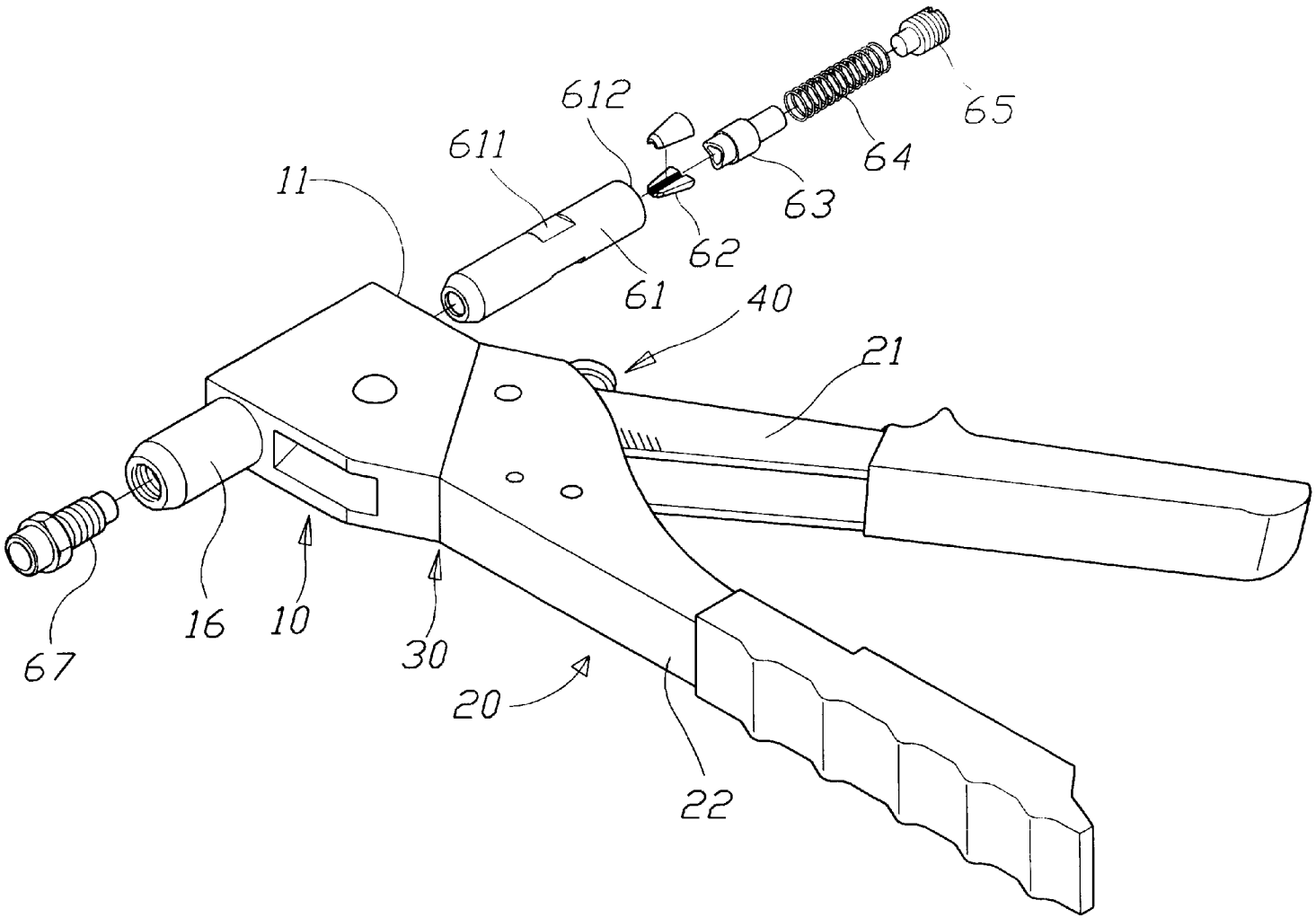
FIG. 4 is an exploded view illustrating the multiple function hand tool according to an embodiment of the present invention.
Figure 5:
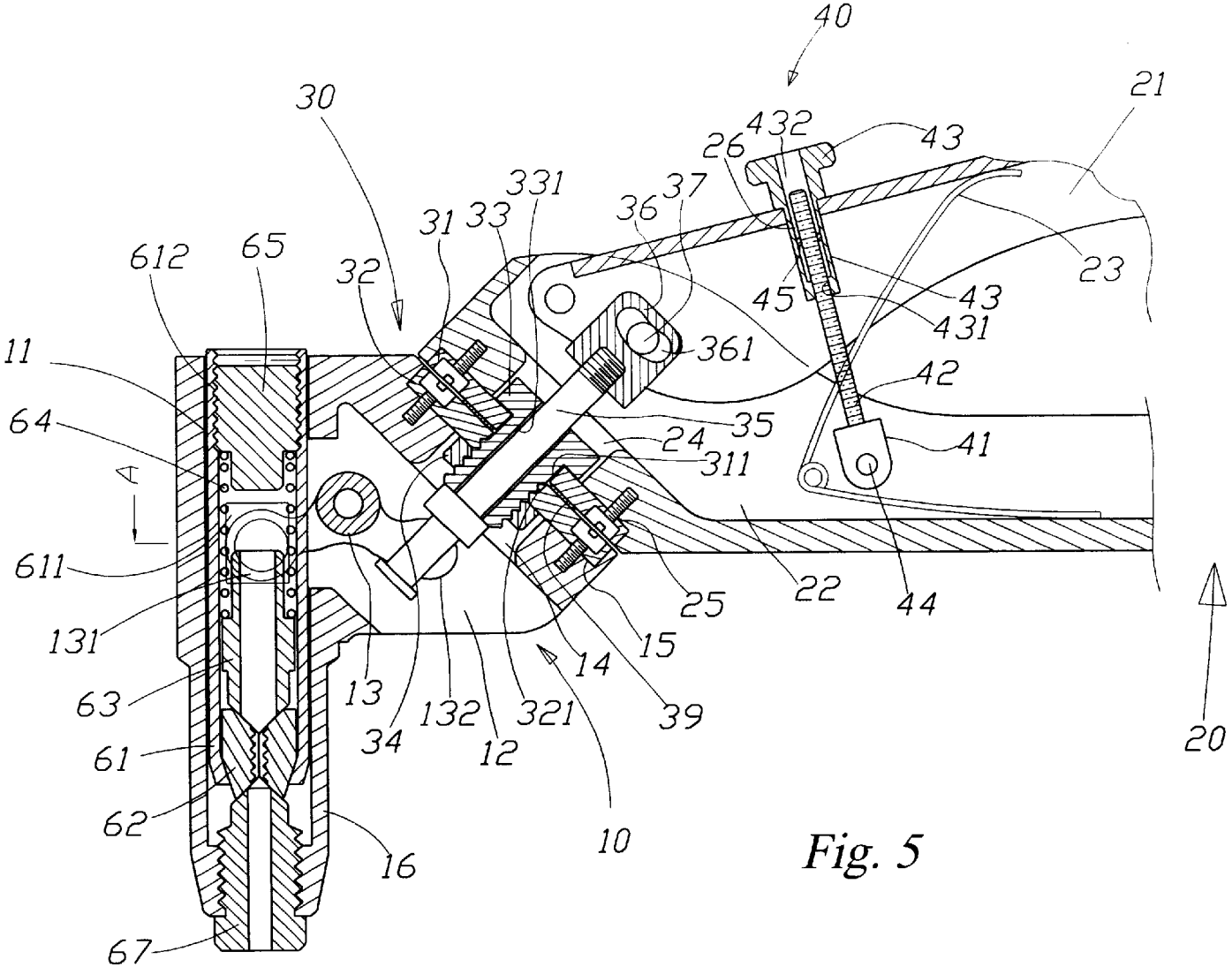
FIG. 5 is a perspective view illustrating the multiple function hand tool according to an embodiment of the present invention.
Figure 6:
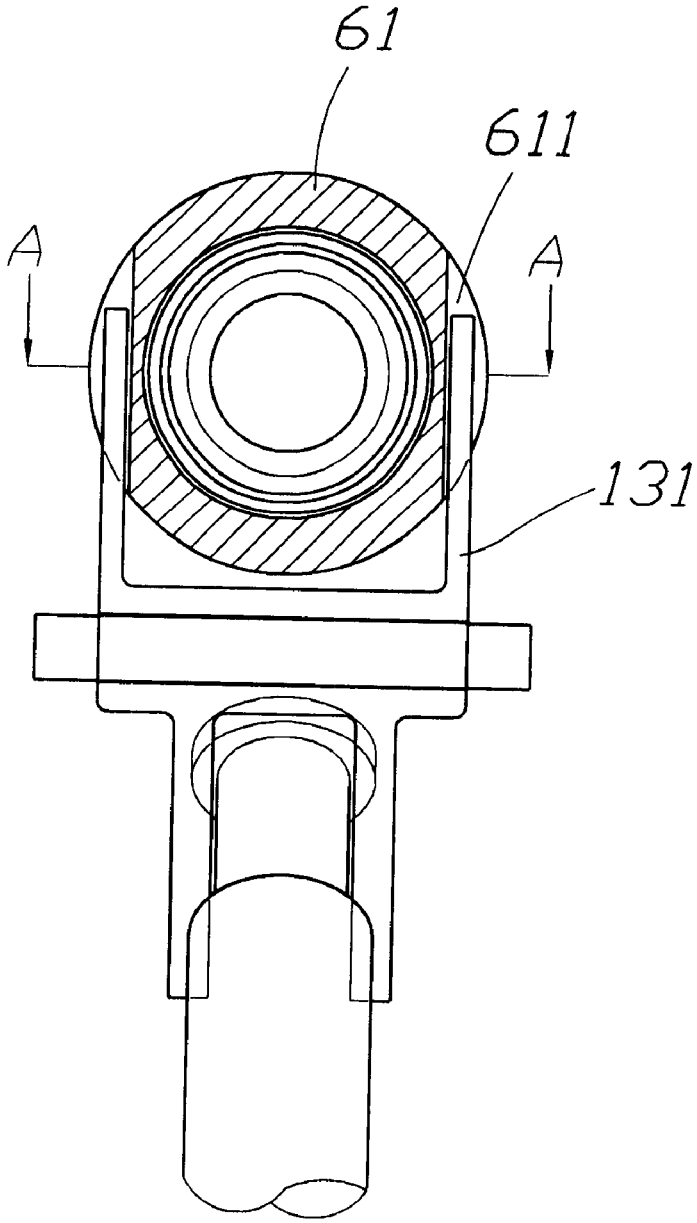
FIG. 6 is a sectional view of FIG. 5 illustrating the multiple function hand tool according to an embodiment of the present invention.

Referring to FIGS. 4 and 5, the connecting device 50 comprises a connecting sleeve 61 which is located in hollow 11 of head device 11 and pull-over member 16 and comprises a recession 611 and an inside thread 612 wherein the recession 611 is moved by the first side 131 of leverage 13 (refer to FIG. 6). The connecting sleeve 61 comprises two clamping members 62, a pressing member 63 and a spring 64 and positions the above mention elements with an adjusting screw 65 screwed to the inside thread 612. Furthermore, the bottom of pull-over member 16 screws to the fastening member 67 wherein the size of the fastening member 67 is changeable according to the diameter of the rivet. When squeezings the upper handle 21 connected to connecting sleeve 61, clamping members 62 to extend backwardly pulling the rivet.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An adjustable hand tool with dual functions comprising:

a head device comprising a hollow and a room;

wherein the hollow further comprises a thread to screw with a pull-over member, and wherein the room further comprises a leverage having a first side and a second side, wherein the first side is coupled to the hollow;

a handle comprising an upper handle and a lower handle;

wherein a spring is located between the upper handle and the lower handle;

wherein the upper handle comprises a positioning hole;

an adjusting device, placed between the head device and the lower handle, comprising at least one wheel and a hole;

wherein a connecting rod passes through the hole and a first end of the connecting rod couples with the second side of the leverage and a second end of the connecting rod couples to the upper handle;

a setting device comprising a connecting nut, a setting rod and a setting nut;

wherein the connecting nut is coupled to the lower handle by a pin;

wherein the connecting nut is screwed to the setting rod;

wherein the setting nut passes through the positioning hole of the upper handle;

wherein the setting rod is fastened to the setting nut by an inside thread of the setting nut;

wherein the setting rod further comprises a rubber pad to increase the friction between the setting nut and the setting rod to prevent looseness; and wherein, when the setting nut is adjusted, the setting rod moves in a direction to adjust the distance between the upper handle and the lower handle; and a connecting device comprising a connecting sleeve and an assembly device;

wherein the connecting sleeve is positioned between the hollow and the pull-over member of the head device;

wherein the connecting sleeve comprises a recession and a thread; and wherein the recession is moved by the first side of leverage.

2. The hand tool of claim 1, wherein the head device couples to the lower handle at 45 degrees.

3. The hand tool of claim 1, further comprising an aperture and a concavity between the head device and the lower handle.

4. The hand tool of claim 3, wherein the adjusting device further comprises an upper wheel and a lower wheel wherein the upper wheel and the lower wheel screw to the concavity between the lower handle and head device.

5. The hand tool of claim 1, wherein the assembly device further comprises two clamping members, a pressing member and a spring held in position by an adjusting screw screwed to the thread of the connecting sleeve.

6. The hand tool of claim 1, wherein a bottom of the pull-over member screws to a fastening member.

* * * * *